US005852839A

United States Patent [19]

Gancy

[11] Patent Number: 5,852,839

[45] Date of Patent: Dec. 29, 1998

[54] INFLATABLE DEVICES WITH FLEXIBLE WALLS HAVING SPRING-LIKE COUPLINGS EXTERNALLY OF AND/OR FORMING PART OF THE WALLS

[76] Inventor: Alan Brian Gancy, 8810 Wandering Way, Baldwinsville, N.Y. 13027

[21] Appl. No.: 794,945

[22] Filed: Feb. 4, 1997

Related U.S. Application Data

[60] Division of Ser. No. 344,066, Nov. 23, 1994, Pat. No. 5,608,931, which is a continuation-in-part of Ser. No. 007, 272, Jan. 21, 1993, abandoned.

[51] Int. Cl.[6] ..... A47C 27/08

[52] U.S. Cl. ..... 5/706; 5/712

[58] Field of Search ..... 5/706, 707, 711, 5/712, 655.3, 655.5, 665, 677, 654; 297/DIG. 3

[56] References Cited

U.S. PATENT DOCUMENTS

| | | | |
|---|---|---|---|
| 272,116 | 2/1983 | Blochman . | |
| 1,610,898 | 12/1926 | Steiner | 5/712 |
| 1,627,835 | 5/1927 | Combs . | |
| 2,016,054 | 10/1935 | Sentell . | |
| 2,360,715 | 10/1944 | Perry . | |
| 2,390,955 | 12/1945 | McDonnell . | |
| 4,541,135 | 9/1985 | Karpov . | |
| 5,608,931 | 3/1997 | Gancy . | |

FOREIGN PATENT DOCUMENTS

| | | |
|---|---|---|
| 1141486 | 2/1983 | Canada . |
| 787421 | 12/1957 | United Kingdom . |

*Primary Examiner*—Alexander Grosz
*Attorney, Agent, or Firm*—Charles S. McGuire; George R. McGuire

[57] ABSTRACT

Apparatus and method for controlling outward movement of flexible walls defining an enclosed chamber of a device inflatable by air or other compressible fluid, the outward movement occurring in response to application of an external force over portions of a flexible wall to decrease the volume and increase the internal pressure of the chamber. Spring-like couplings, preferably in the form of elastic members such as "rubber bands," are attached at spaced points to portions of the flexible, relatively moveable walls inside and/or outside the chamber. The couplings are so attached as to be expanded or stretched by relative movement of the flexible wall portions as the external force is applied, whereby the members exert a force resiliently opposing movement of the flexible walls in response to the increase in internal pressure caused by application of the external force. In a practical application, the enclosed chamber is an air mattress and the controlled movement of the flexible walls advantageously affects the tactile response of a user to the body-supporting upper wall of the mattress. The spring-like couplings may form one or more portions of the flexible walls of the chamber.

6 Claims, 3 Drawing Sheets

INFLATABLE DEVICES WITH FLEXIBLE WALLS HAVING SPRING-LIKE COUPLINGS EXTERNALLY OF AND/OR FORMING PART OF THE WALLS

REFERENCE TO RELATED APPLICATION

The present application is a division of application Ser. No. 08/344,066, filed Nov. 23, 1994, now U.S. Pat. No. 5,608,931, which is a continuation-in-part of application Ser. No. 08/007,272, filed Jan. 21, 1993, now abandoned.

BACKGROUND OF THE INVENTION

The present invention relates to springlike couplings, and novel arrangements of said couplings, connected between and opposing outward relative movement of flexible wall members, particularly wall members of an inflatable device to which external pressure is applied in certain areas under normal conditions of use urging the walls inwardly in the areas of applied pressure and outwardly in other areas where the couplings of the present invention resiliently oppose such outward movement.

In many forms of inflatable devices pneumatic pressure is applied internally of relatively moveable wall portions to resist external pressure applied to such wall portions under normal conditions of use. Examples of such inflatable devices include air mattresses, pillows, and the like, intended to support the human anatomy, or portions thereof. Such devices normally include walls of flexible material forming one or more separate or communicating, enclosed chambers which may be inflated and deflated through one or more openings which may include an appropriate check valve, or the like.

Inflatable devices having flexible wall portions are prepared for use by injection of air or other gas into the enclosed chamber until the static pressure reaches a desired magnitude, normally dependent upon the intended nature of use of the inflated device. In the previously mentioned example of an air pillow or mattress, the device is inflated to an internal pressure which provides the degree of "firmness," i.e., the degree of resistance to an externally applied force, desired by the user. This may vary, of course, from one user to another, but is a variable entirely within the user's control.

Assuming the wall portions of an inflatable device to be of flexible, substantially inelastic material, application thereto of an external force will tend to reduce the volume of the inflated chamber with resulting increase in internal pressure. The gas pressure will, of course, be evenly distributed over the internal walls of the chamber enclosed by the wall to which external force is applied.

In some forms of inflatable devices, notably those intended to support human anatomy, it may be desirable to control factors in addition to the aforementioned "firmness" of the flexible walls. For example, when a person's body or head is placed on an air mattress or pillow, the weight applied as an external force causes inward deformation of the wall in the areas contacted and the increased internal pressure is applied equally to all wall portions, including those to which no external force is applied. Accordingly, the tactile response imparted by the supporting surface to the user does not provide the optimum comfort level. This problem has not previously been satisfactorily addressed.

It is a principal object of the present invention to provide novel and improved means for opposing an outwardly directed force applied to flexible, relatively moveable wall members with results which may be usefully employed in structures wherein the force-opposing means are incorporated.

Another object is to provide a gas inflatable device having at least one flexible wall member with novel means for controlling response of the wall to an externally applied force.

A further object is to provide a system of elastic spring members incorporated with an inflatable device to oppose the outward force of gas pressure in a manner which achieves novel and desirable response of a flexible wall of the device to externally applied forces.

Still another object is to provide an inflatable device such as an air mattress or pillow having novel and improved means for achieving a desirable and hitherto unattainable tactile response in a flexible surface intended to support some or all of a human anatomy.

Other objects will in part be obvious and will in part appear hereinafter.

SUMMARY OF THE INVENTION

In accordance with the foregoing objects, the invention contemplates a structure having wall means with surface portions relatively moveable by application of an outwardly directed force with elastic spring means connected between or otherwise associated with or incorporated in wall or surface portions to oppose the outwardly directed force. The spring means are disclosed in the form of elastic bands or loops. The elastic members may be connected between the opposed surfaces of the inflatable device at spaced positions in various combinations of lengths, spring forces, physical arrays, etc., each producing a different response in the flexible walls means of an inflated device to an externally applied force.

In a principal form of practical application, the elastic spring means are employed in an air mattress or pillow for supporting, in an inflated condition, the body and/or head of a user. The mattress or pillow includes the usual wall portions of flexible, substantially inelastic material forming one or more enclosed, gas-impervious chambers, usually with appropriate opening(s) for selective inflation and deflation. A plurality of elastic strips or loops are fixedly attached at opposite end portions to the opposing, upper and lower, internal surfaces of the walls at spaced positions. In some forms, a single elastic member may be employed or the elastic portion may form part of the flexible walls of the enclosed chamber.

Each elastic member has a predetermined length in the fully extended, unstretched condition and is elongated by outward relative movement of the surfaces to which it is attached past a distance wherein the elastic member exceeds its predetermined length. The maximum elongated length of each elastic member may be limited by attaching a substantially inelastic member to the opposing internal surfaces to prevent outward relative movement thereof past the distance representing the maximum desired length of the elastic members.

Embodiments are described wherein the elastic members within an enclosed chamber are all of the same unstretched length and strength (spring force), wherein at least some members are of different lengths than others, wherein at least some members are of different strengths than others, and wherein some members are of both different lengths and strengths than others. In other disclosed embodiments, elastic members are attached to portions of the flexible walls externally of the chamber enclosed by the walls.

The foregoing and other features of construction and operation of the invention will be more readily understood and fully appreciated from the following detailed description, taken in conjunction with the accompanying drawings.

DETAILED DESCRIPTION

Figure 1:
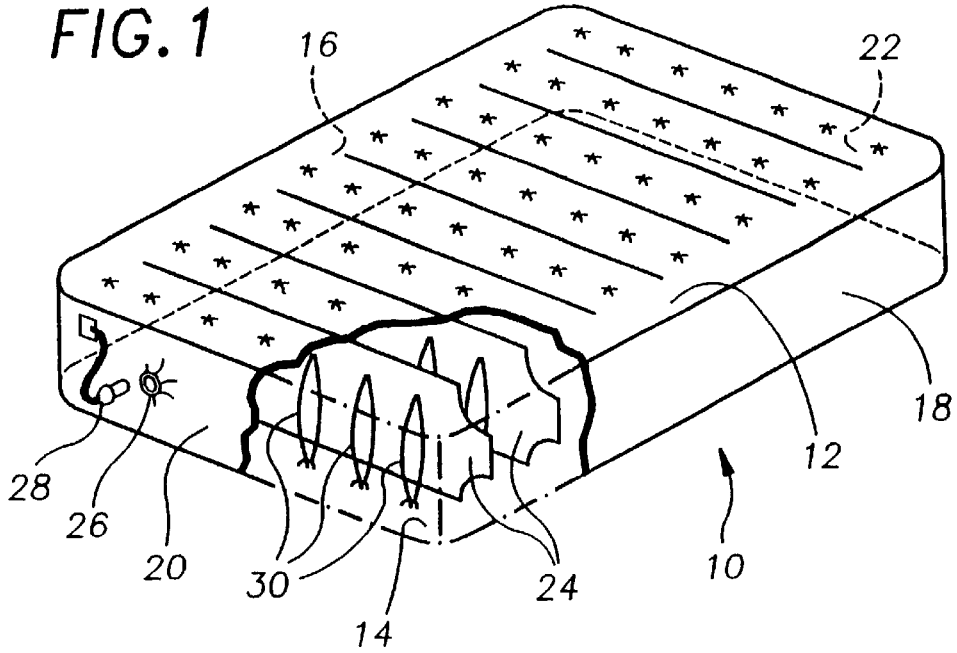
FIG. 1 is a perspective view, with portions broken away, of an air mattress incorporating a first embodiment of the invention.

Referring now to the drawings, in FIG. 1 is shown an inflatable device in the form of an air mattress, denoted generally by reference numeral 10, having upper and lower walls 12 and 14, respectively, connected by side walls 16 and 18, and by end walls 20 and 22. All of the walls are of flexible, essentially inelastic, gas impermeable material, whereby mattress 10 may be folded or rolled to a compact condition when deflated. Any of the materials employed in the construction of prior art inflatable devices of this type are suitable for use as the walls of the device of the present invention. In order that the mattress maintains the desired, generally box-like shape when inflated, it is conventional to provide a uniformly spaced series of internal webs 24, also of flexible, inelastic material connecting the upper and lower walls to limit the maximum spacing thereof along lines where the webs are connected. Many of the materials conventionally used in such devices may be connected to one another at fluid-impervious seams by ultrasonic or heat welding.

Mattress 10 may be inflated and deflated through an opening 26 which is sealed by a removable plug 28 when the mattress is inflated. Webs 24 do not extend entirely across the interior of mattress 10, leaving fluid passageways to provide a continuous chamber so that fluid pressure is distributed equally over the internal surfaces of mattress 10. Although webs 24 are shown extending sideways of the mattress, it is also conventional to employ webs extending lengthwise. As will be seen, the present invention may be employed in air mattress or other inflatable devices with internal webs extending in any direction, as well as in devices having no internal webs. It will be further understood that, although mattress 10 is illustrated as having discrete side and end walls, the invention may be practised in devices wherein upper and lower walls are joined directly to one another at peripheral seams about the sides and ends.

Prior art inflatable devices having the conventional features discussed above are, of course, intended to support some or all of a human anatomy with the cushioning effect of the inflated air chamber providing greater comfort than otherwise available surfaces. The device may be selectively inflated within a range of relatively higher or lower pressures to provide a degree of firmness desired by the user. If the device is inflated to a pressure so high that the load or external force applied does not produce at least some deflection of the underlying flexible wall, the effect is the equivalent of a rigid surface. Thus, it is assumed that at least some degree of wall deflection occurs when the external force is applied, e.g., by the user's head or body, normally in a downward direction on the upper wall.

The internal pressure, of course, increases upon application of an external force sufficient to reduce the volume of the air chamber and compress the gas therein. The increase in pressure in areas other than those where the load is applied urges the walls outwardly with greater force than the initial inflation pressure. That is, while the upper wall is deflected downwardly in the area of applied external force, it is urged outwardly and becomes firmer other areas. This action of the mattress surface is unique to air mattresses, as opposed to inner-spring, foam and other conventional types of non-inflated mattresses, and produces a noticeably different "feel" or tactile response in the user.

The present invention provides means for changing the tactile response imparted to a user by an air mattress, or other inflatable device, giving the mattress a "feel" more akin to that of non-inflated mattresses. This is done by opposing outward movement of the flexible mattress walls by one or more springlike couplings inside or outside the air chamber. The couplings act to increase the force opposing outward movement in predetermined relation to increase in such outward movement. The springlike couplings are disclosed in several embodiments in the form of strips or loops of elastic material, akin to conventional rubber bands, which may be affixed or supported in many different configurations and combinations within the inflatable device.

Referring again to the drawings, a plurality of elastic loops 30 are affixed at opposite ends by any convenient connecting means to the inner, opposing surfaces of upper and lower walls 12 and 14, respectively, as seen in FIG. 1. Preferably, loops 30 are affixed in evenly spaced relation, a few inches apart, over the entire opposing surface areas of walls 12 and 14.

Figure 2:
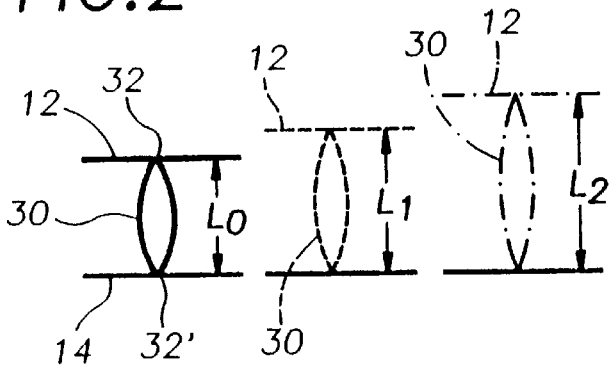
FIG. 2 is an enlarged, elevational view showing one of the elastic members of FIG. 1 in three conditions of extension.

One of loops 30 is shown in the enlarged view of FIG. 2, fixedly attached at 32, 32' by any suitable connecting means to the opposing surfaces of walls 12 and 14, respectively. Loop 30 is shown in solid lines in fully extended but unstretched condition, wherein it has a length $L_0$, in dashed lines in a stretched condition with length $L_1$, and dot-dash lines in a further stretched condition having a length $L_2$. Preferably, walls 12 and 14 are spaced as shown in solid lines, with loops 30 fully extended but unstretched, before mattress 10 is fully inflated; the stretched lengths $L_1$ and $L_2$ may correspond to fully inflated and over-inflated conditions of mattress 10. That is, when mattress 10 is inflated to a typical, desired pressure loops 30 will be stretched to a length $L_1$ and, in tending to return to their unstretched length, will exert an inward force on walls 12 and 14, opposing the outward force of the positive air pressure.

When an external force is applied to the flexible walls of mattress 10, e.g., when a person lies down upon the outer surface of upper wall 12, the volume of the air chamber is decreased with a proportionate increase in pressure. Since lower wall 14 will normally be resting upon an essentially rigid surface, there is no change in its configuration. However, the increased internal pressure applied to the other walls will result in outward bulging of side walls 16 and 18, end walls 20 and 22, and the areas of upper wall 12 other than those to which the external load is applied. For example, a particular load, e.g., the weight of a typical or average user, may cause outward (i.e., upward) movement of upper wall 12 in non-load supporting areas by a distance equal to the difference between lengths $L_2$ and $L_1$.

At this point it should be noted that the increase in pressure which produced the movement of wall 12 by distance $L_2$-$L_1$ would have produced an even greater movement but for the force of loops 30 opposing such movement. The force required to produce a given increment of elongation of loops 30 increases as the length or amount of deflection of the loops increases. Thus, assuming $L_1$ to be equally longer and shorter than $L_0$ and $L_2$, respectively, a greater force is required to move wall 12 from the middle to the outer position of FIG. 2 than from the inner to the middle position.

Figure 3:
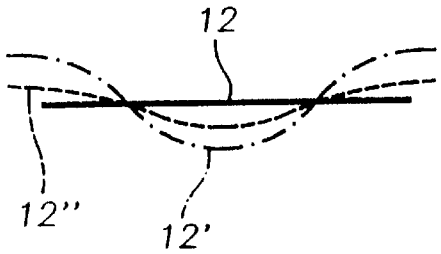
FIG. 3 is a cross-sectional, end elevation of the air mattress of claim 1 illustrating the effect of the present invention on contour of the upper wall when an external force such as a user's body is applied thereto.

The effect of the invention on response of the load-bearing surface is illustrated in FIG. 3. Solid line 12 indicates the position of the upper wall when mattress 10 is inflated to the desired degree, but no load is applied. Dashed line 12' indicates the upper wall position when a load is applied in a prior art air mattress, i.e., without means opposing upward movement of the upper wall, and dot-dash line 12" indicates the wall position when the same load is applied and the movement-opposing means of the present invention are employed. Although the increments of wall movement may be fairly small, and the response characteristics of the upper wall may be more apparent in the degree of hardness or stiffness than in the amount of movement, there is a great deal of difference in the tactile response or feel of the mattress which is imparted to the user.

Figure 4A:
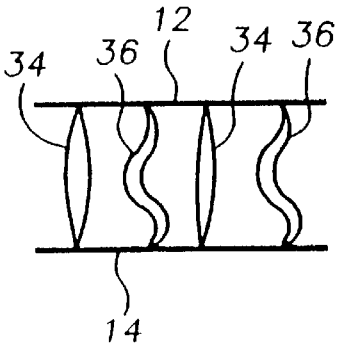
FIGS. 4*a*–4*c* are fragmentary, elevational views illustrating the use of elastic members of different effective lengths and//or strengths connected at spaced points between the upper and lower walls of an air mattress.
Figure 4B:
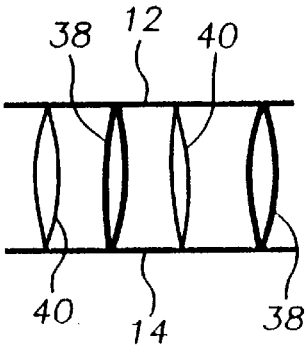
Figure 4C:
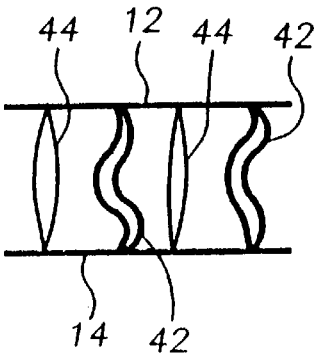

While the foregoing has explained in somewhat simplified terms the principles of operation of the invention, many modifications, combinations, etc. of the elastic members and their connections to and incorporation with the wall members of the inflatable device are contemplated within the scope of the invention. For example, elastic strips of different lengths, strengths, or both may be employed in parallel and/or series combinations. FIGS. 4*a*–4*c* provide simplified illustrations of several such combinations using a plurality of elastic loops connected directly between walls 12 and 14 in evenly spaced relation in a single row. In FIG. 4*a,* loops 34 are alternated with loops 36. Although all loops are of the same strength, (i.e., they are equally elongated by the same applied force) they have different effective lengths in their fully extended, unstretched conditions. In the illustrated spacing of walls 12 and 14, relatively shorter loops 34 are fully extended, but unstretched, while loops 36 are not yet fully extended. In this position, none of loops 34 and 36 exerts any force on walls 12 and 14. However, loops 34 will be stretched by further relative movement of walls 12 and 14 away from one another, and will thus exert a force opposing such movement. When the distance between walls 12 and 14 exceeds the fully extended, unstretched length of loops 36, these loops will also exert a force (in addition to that of loops 34) opposing further movement of walls 12 and 14 away from one another. Thus, as the distance between walls 12 and 14 increases, the effects of loops 34 and 36 is cumulative, exerting an ever-increasing force opposing further separating movement of walls 12 and 14.

Similar effects are produced by alternating elastic strips or loops of different strengths in the couplings between walls 12 and 14. Loops 38 and 40 of FIG. 4*b* have the same effective lengths, all being shown in their fully extended, unstretched condition. However, loops 38 are stronger than loops 40, requiring greater force to produce the same amount of elongation and thus exerting a greater force than loops 40 opposing further separating movement of walls 12 and 14. The arrangement of FIG. 4*c,* wherein loops 42 are both stronger and of greater effective length than loops 44, produces yet another type of response in the upper wall of mattress 10 to increase internal pressure.

Figure 5:
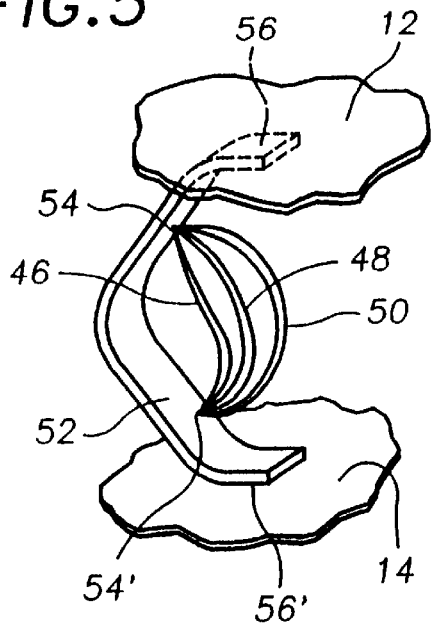
FIG. 5 is a perspective view of a plurality of elastic members connected in parallel relationship to successively act upon the air mattress walls.

Rather than attaching loops of different length and/or strength in separate, spaced relation to one another over opposing surface areas of the upper and lower walls, a plurality of elastic members may be attached in parallel fashion at the same points. Also, means may be provided to limit the maximum, stretched lengths of the elastic members. An example of such parallel attachment with stretch limiting means is shown in FIG. 5. Inner, middle and outer loops 46, 48 and 50, respectively, are all attached to strip 52 at spaced points 54, 54' thereon. Strip 52, of flexible, essentially inelastic material, is attached at its opposite ends to points or areas 56, 56' on opposed surfaces of walls 12 and 14.

In the position shown in FIG. 5, inner loop 46 is at its fully extended, unstretched length, whereby further separating movement of walls 12 and 14 will be opposed by the force required to stretch loop 46. When the distance between walls 12 and 14 exceeds the fully extended, unstretched length of middle band 48, the force required to effect further separating movement of the walls is now increased to the sum of the forces required to stretch both loop 46 and 48. Separating movement of walls 12 and 14 past the fully extended, unstretched length of outer loop 50 is opposed by the force required to stretch all three loops. The maximum spacing of the opposed surfaces of walls 12 and 14 at points 56, 56', and thus the maximum stretched lengths of loops 46, 48 and 50, is defined by the effective length of strip 52.

Figure 6:
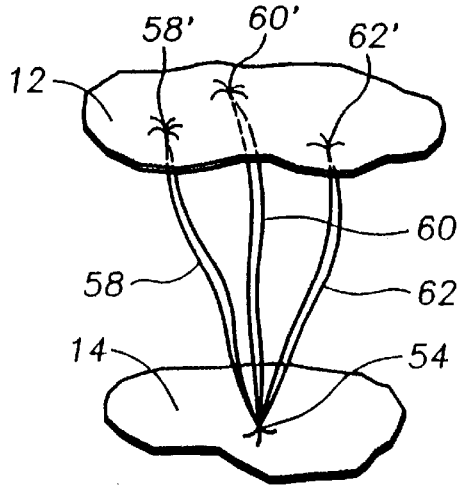
FIG. 6 is a perspective view of a three-dimensional array of elastic members.

In some applications, it may be desirable to have a greater number of points to which force opposing separating movement is applied on one wall than on the other. For example, it is the tactile response characteristic of only the upper wall of an air mattress which are relevant to the desired objective. The number or location of points of attachment of the force-applying members to the lower wall, or to other internal portions of the mattress, are not particularly important to the feeling imparted by the upper wall to a person reclining thereon. However, the surface contour of the upper wall will be more uniformly and effectively controlled in the desired manner by a relatively large, as opposed to a relatively smaller number of force-applying points, i.e., points at which the elastic strips or their contacting means are attached to the wall. Such an arrangement is illustrated in FIG. 6, wherein elastic loops 58, 60 and 62 are attached at three spaced points 58', 60' and 62', respectively, to upper wall 12 and at a single point 64 to lower wall 14 providing, in effect, a three-dimensional array of elastic members.

Figure 7:
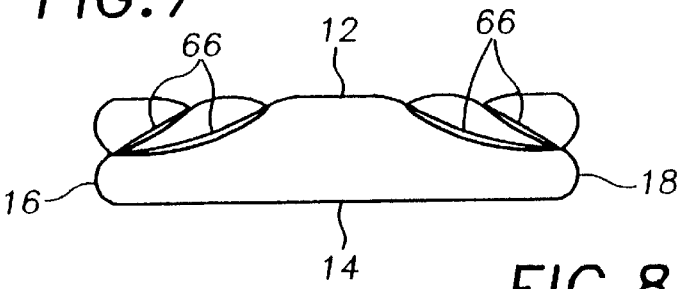
FIGS. 7–9 are sectional views illustrating further embodiments of the elastic members and their manner of attachment to an inflatable device.
Figure 8:
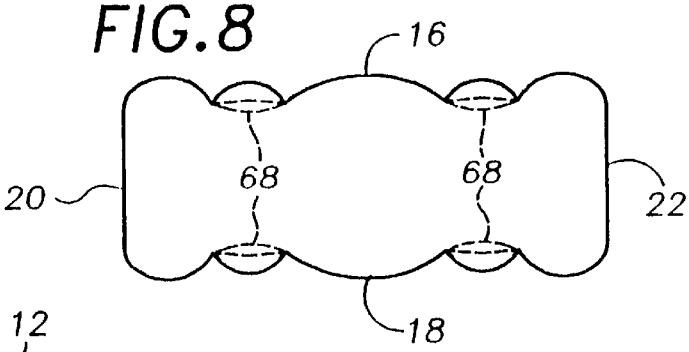
Figure 9:
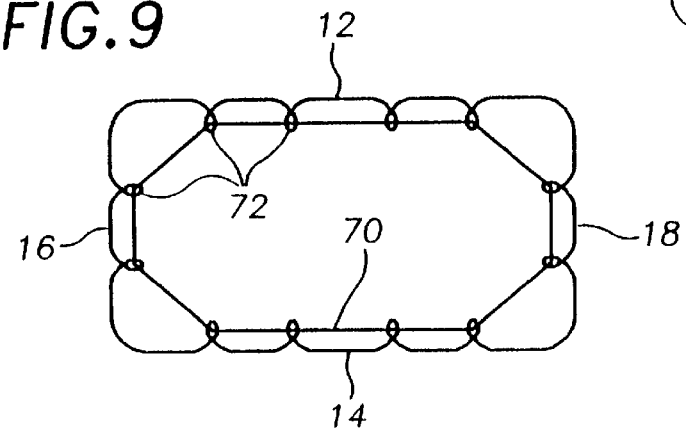

In the previous examples, the elastic members were connected directly or indirectly (as through inelastic strip 52) to opposed surfaces of the upper and lower walls. It is also possible to connect the elastic members to relatively moveable portions of the air chamber structure in different locations or manner of attachment, several examples of which are shown in FIGS. 7–9. Elastic members 66 are attached between spaced points on upper wall 12 and on side walls 16 and 18 in the embodiment of FIG. 7; obviously, elastic members could additionally or alternatively be connected between the upper wall and the end walls and/or inelastic web members 24.

Although not as well suited to control of tactile response in the upper wall of an air mattress, or the like, the principles of the invention may be employed in other ways to control expansion of air chambers fully or partially enclosed by flexible walls. Elastic members 68 are attached between two points on the same wall in the embodiment of FIG. 8. The fully extended, unstretched lengths of members 68 is less than the distance, measured along the wall to which they are attached, between the points of attachment. Although members 68 are shown in FIG. 8 as attached to side walls 16 and 18, elastic members may instead, or in addition, be attached at spaced points on other common walls.

Still another possible manner of connection is shown in FIG. 9, wherein continuous elastic member 70 extends entirely around the inner perimeter of the air chamber. Member 70 extends freely through eyes 72 which are fixedly attached at spaced points about the inner surfaces of the walls of the air chamber. Thus, although elastic member 70 is connected to the air chamber walls, it is not fixedly attached thereto. A plurality of elastic members 70 may be connected in spaced planes along the length, the width, or both, of the air chamber. Furthermore, one or more continuous elastic members may extend through eyes attached about the side and end walls, i.e., in planes more or less parallel to the upper and lower walls. The distance around the unstretched elastic members 70 is less than the distance around the inner wall of the air chamber in the places where eyes 72 are attached, whereby members 70 are stretched as the air chamber is expanded and, conversely, exert a force opposing such expansion beyond the unstretched lengths of members 70.

The previously described embodiments are all concerned with application to flexible wall portions of a resilient force by means of elastic members positioned internally of the inflated chamber. The invention also contemplates the use of elastic members which are connected to relatively moveable, flexible wall portions externally of the enclosed chamber, as well as gas-impervious, elastic members which themselves form portions of the enclosure.

Figure 10:
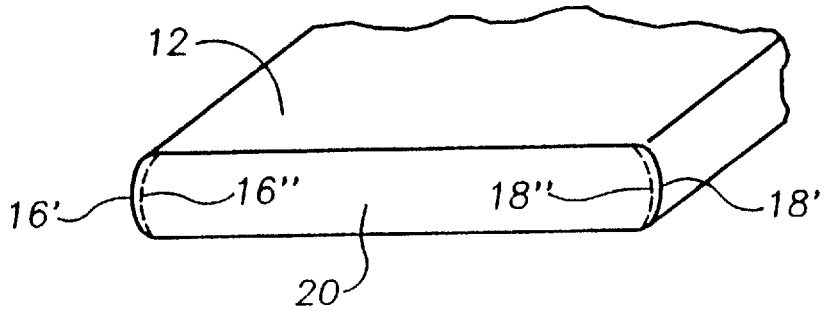
FIGS. 10 and 11 are fragmentary, perspective and top plan views, respectively, of embodiments wherein the elastic members form portions of the enclosure walls or are otherwise incorporated in the inflatable device externally of the enclosed chamber.

In FIG. 10 is shown a portion of an air mattress having upper wall 12 and end wall 20, as well as the lower wall and opposite end wall of the previously described embodiments. Side walls 16' and 18' are of elastic material connected at their peripheries to the upper, lower and end walls. After exceeding their fully extended, unstretched length, elastic wall members 16' and 18' will stretch as internal pressure is increased, thus permitting further outward movement (i.e., bulging or ballooning) of the flexible wall members of the chamber while exerting a resilient force opposing such movement.

Also shown in dotted lines are side wall members 16" and 18". Elastic members 16' and 18' may be of rubber or other gas-impermeable material, and provide the sole side walls of the enclosed chamber; alternatively, side wall members 16" and 18", of flexible, essentially inelastic, gas-impervious material, may be provided in addition to walls 16' and 18' to form the side walls of the enclosed chamber. In applications where walls 16" and 18" are employed in conjunction with walls 16' and 18' it is necessary, of course, that the length of wall members 16" and 18" between the upper and lower walls exceeds the fully extended, unstretched length of elastic members 16' and 18' so that the latter will exert the desired resilient control of movement of the flexible walls prior to full inflation of the device.

Figure 11:
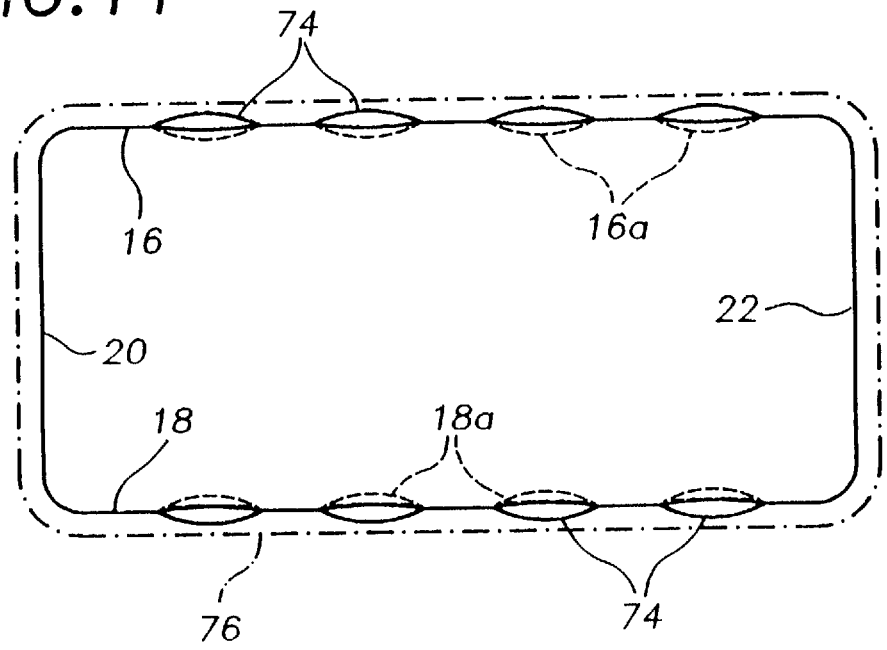

A further embodiment employing elastic members attached to relatively moveable wall portions externally of the enclosed chamber is illustrated in the top view of FIG. 11. Elastic members 74, again shown in loop ("rubber band") form, are connected at opposite, terminal ends of each of members 76 to spaced points (positions) on the outer surfaces of side walls 16 and 18. Portions 16*a* and 18*a* of side walls 16 and 18, respectively, i.e., the portions between the points at which each member 74 is connected, are shown in dotted lines to illustrate more clearly that the elastic members are connected exteriorly of the enclosed chamber and that the distance along the surface of the wall between the points of connection of each elastic member is greater than the fully extended, unstretched length of the elastic members. It will be understood, of course, that no portions of the flexible walls would actually be concave, even when the device is only partially inflated, when elastic members are attached externally of the walls. On the other hand, a certain amount of localized concavity or "dimpling" is present under most inflated conditions at or surrounding the points of attachment of elastic members to internal portions of the flexible walls, as indicated in some of the previously described Figures.

Elastic members may form or be used in conjunction with external portions of any or all of the flexible walls forming an enclosed chamber of an inflatable device in a manner resiliently controlling outward movement of such walls under the influence of an externally applied load. It may be desirable to cover or conceal elastic members attached to the exterior of the device. For this purpose the device may be enclosed in a removable, flexible cover of fabric, plastic, or other appropriate material, such as indicated in phantom lines and denoted by reference numeral 76 in FIG. 11. Attaching the elastic members exteriorly of the flexible walls offers the advantages of easier and possible cheaper fabrication, as well as much faster and easier replacement of elastic members due to breakage, wear, etc.

It should be noted that, although not shown in all embodiments, means such as a flexible, inelastic strip fixedly connected to internal portions of the air chamber to limit separating movement of the elastic member(s) to a predetermined maximum may be, and preferably are for most applications, employed with any configurations or means of attachment of the elastic members. The elastic members themselves may take any of a wide variety of configurations, ranging from the illustrated relatively narrow, continuous loops ("rubber bands") to strips extending from partly to essentially fully across the width and/or length of the chamber. Such elastic strips could, for example, replace the webbing of inelastic material conventionally used in air mattresses, or be used in conjunction therewith so that the inelastic webbing limits the maximum stretched length of the elastic member(s).

From the foregoing, it will be appreciated that the invention influences behavior of inflatable devices in a novel manner by connecting one or more spring-like couplings between relatively moveable portions of the device. Although shown and described in their preferred form of strips or loops of elastic material, uniformly stretchable throughout their length, the spring-like couplings may take other conventional or customized forms. Such forms could include plastic or metal spring members of coil or other configuration, the main constraint being that the spring-like couplings are tensioned when expanded or extended from an unstressed condition to exert a force opposing movement of wall portions of an inflatable device by fluid pressure.

A major, useful application of the principles of the invention is the control of surface characteristics of a flexible wall intended to support all or portions of human anatomy. For example, air mattresses and pillows incorporating the invention impart to a user a tactile response much more akin to that of stuffed or compression-spring mattresses, or of stuffed or foam-type pillows than prior art inflatable devices. This is believed to be due to the resiliently controlled bulging or ballooning of the flexible wall of the surface to which pressure is applied, particularly in areas immediately surrounding the surface portion to which pressure is applied by the user's body, head, etc. Although there is an increase in fluid pressure within the device when the external force is applied, the ballooning effect of this pressure increase, particularly important in the areas surrounding the applied force (e.g., the user's body), is resiliently controlled by the forces of the spring-like couplings opposing such movement.

What is claimed is:

1. In an inflatable device having flexible wall means forming at least a portion of a gas-impervious chamber, said wall means being outwardly moveable over a predetermined range of movement in response to pressure of a compressible fluid acting uniformly over an internal surface of said chamber, means resiliently opposing said outward movement over at least a portion of said range of movement, said resiliently opposing means comprising:

a) spring-like coupling means having opposite, terminal ends and being expandable by an applied force, said coupling means exerting an opposing force resisting expansion, at least a portion of said coupling means being positioned externally of said chamber; and b) means connecting said opposite ends of said coupling means to spaced positions on said wall means for application of said fluid pressure to said coupling means as said applied force, whereby said coupling means is expanded by said fluid pressure and exerts said opposing force upon said wall means.

2. A device having an enclosed chamber inflatable with a compressible fluid which exerts a pressure uniformly over each incremental area of inner surfaces of said chamber, said device comprising:

a) flexible, fluid-impervious wall means defining at least a portion of the enclosure of said chamber; and b) resilient coupling means comprising at least one elastic member positioned externally of said chamber and having opposite end portions fixedly attached to spaced portions of said wall means for exerting a resilient, mechanical force acting upon said wall means in opposition to movement thereof in response to force exerted by said fluid pressure.

3. An inflatable device comprising:

a) flexible, fluid-impervious wall means defining an enclosed chamber for inflation with a compressible fluid, said wall means including first and second, substantially inelastic wall portions relatively moveable away from one another in response to increase of the pressure of said fluid; and b) spring-like coupling means positioned externally of said chamber and having opposite end portions connected to spaced portions of said first and second wall portions for expansion of said coupling means by said relative movement of said wall portions, at least past a predetermined spacing, to exert a resilient force opposing said relative movement, said force increasing as the spacing of said wall portions increases past said predetermined spacing.

4. An inflatable device comprising:

a) flexible wall means (12, 16', 18', 20) forming at least a portion of a gas-impervious chamber, said wall means forming the exterior of said chamber and being outwardly moveable over a predetermined range of movement in response to gas pressure acting uniformly over the interior of said chamber;

b) a first portion (12, 20) of said wall means being of substantially inelastic material;

c) a second portion (16', 18') of said wall means being of elastic material having maximum, unstretched dimensions; and d) means mutually connecting said first and second portions about peripheral portions thereof, whereby application of said gas pressure to the interior of said chamber exerts a force on said wall means and, when said force causes said second portions to exceed their fully extended, unstretched length, said second portions permit further outward movement of said wall means while exerting a resilient force opposing such further outward movement.

5. An air mattress, or the like, defining an inflatable chamber, said mattress comprising:

a) top (12) and bottom (14) walls of substantially inelastic material relatively moveable away from one another in response to air pressure applied within said chamber;

b) side (16', 18') and end (20, 22) walls at least a predetermined portion (16', 18') of which are of elastic material having predetermined, maximum, unstretched dimensions; and c) means connecting said top, bottom side and end walls so the application of gas pressure within said chamber to exert an outward force sufficient to stretch said predetermined portion beyond said unstretched dimensions exerts a resilient force opposing said movement of said top and bottom walls away from one another.

6. The invention according to claim 5 and further including additional wall members (16", 18") of substantially inelastic material connected within said chamber to portions thereof to prevent the stretched dimensions of said predetermined portion from exceeding a desired maximum.

* * * * *